United States Patent [19]

Counard

[11] Patent Number: 4,819,558

[45] Date of Patent: Apr. 11, 1989

[54] HIGH EFFICIENCY FLUID METERING ROLL

[75] Inventor: Cletus J. Counard, Willingboro, N.J.

[73] Assignee: Pamarco Incorporated, Roselle, N.J.

[21] Appl. No.: 724,778

[22] Filed: Apr. 18, 1985

[51] Int. Cl.[4] ..... B41F 1/46; B41F 31/14

[52] U.S. Cl. ..... 101/348; 101/350; 29/121.2; 29/121.4

[58] Field of Search ..... 101/348, 349, 350; 29/121.1, 121.2, 121.3, 121.4, 121.5

[56] References Cited

U.S. PATENT DOCUMENTS

| | | | |
|---|---|---|---|
| 3,285,169 | 11/1966 | Hartwig | 101/350 X |
| 3,329,085 | 7/1967 | Bivans et al. | 101/350 X |
| 4,009,658 | 3/1977 | Heurich | 29/121.2 X |
| 4,016,811 | 4/1977 | Zavodny | 29/121.1 X |
| 4,195,570 | 4/1980 | Haren | 101/348 |
| 4,246,842 | 1/1981 | Williams et al. | 101/348 X |
| 4,301,583 | 11/1981 | Poole | 29/121.4 X |
| 4,445,433 | 5/1984 | Navi | 101/350 |
| 4,537,127 | 8/1985 | Fadner et al. | 101/350 X |

FOREIGN PATENT DOCUMENTS

| | | | |
|---|---|---|---|
| 962125 | 2/1975 | Canada | 101/350 |
| 820365 | 9/1959 | United Kingdom | 101/350 |
| 928383 | 6/1963 | United Kingdom | 101/350 |

*Primary Examiner*—Paul T. Sewell
*Assistant Examiner*—James R. McDaniel
*Attorney, Agent, or Firm*—Mark T. Basseches; Paula T. Basseches

[57] ABSTRACT

A fluid metering roll is embossed with chains of cells, the cells of each chain being interconnected by channels. Certain of the walls of the cells are aligned at critical angles relative to the axis of the roll. The channels are oriented and arranged to assure a flushing of all portions of the cells so as to eliminate ink encrustation and maximize ink spread to avoid striations and moire effects.

7 Claims, 1 Drawing Sheet

HIGH EFFICIENCY FLUID METERING ROLL

BACKGROUND OF THE INVENTION

1. Field of the Invention

The present invention relates to improvements in fluid metering rolls or, as they are often referred to, anilox rolls.

Anilox rolls are frequently employed in the printing industry to transfer accurately metered amounts of ink from a fountain roll coated with ink picked up from an ink bath or reservoir or from the bath itself to a printing roll or the like. The anilox roll is typically wiped by a doctor blade or the like to assure even filling of the cells impressed in the surface thereof. Metered quantities of ink from the cells are thence transferred to a printing plate roller or cylinder, which in turn transfers ink patterns to the sheet or web to be printed, the web being passed in the nip between the plate roller or cylinder and an impression cylinder.

2. The Prior Art

Conventional anilox rolls have included a multiplicity of closely spaced cells, the configurational characteristics of which may be varied in accordance with the transfer characteristics of the inks with which they are intended to be used. Generally such cells may be in the form of inverted hemispheres, pyramides, cones or the like, the roll including land areas between adjacent cells which define a wiping or support area for the doctor blade.

Representative examples of anilox rolls having cells of the type hereinabove set forth may be found in U.S. Pat. Nos. 2,217,552 of Oct. 8, 1940; 2,393,529 of Jan. 22, 1946; 3,651,758 of Mar. 28, 1972 and 3,974,554 of Aug. 17, 1976.

Examples of anilox rolls having special cell characteristics may be found in U.S. Pat. No. 3,613,578 of Oct. 19, 1971, assigned to the assignee of the instant application. U.S. Pat. Nos. 4,009,658 of Mar. 1, 1977 and 4,301,730 of Nov. 24, 1981, both likewise owned by the assignee hereof, are examples of anilox rolls having improved wear characteristics by virtue of the formation of the cells in a ceramic coating or matrix.

U.S. Pat. No. 4,155,766 of May 22, 1979 is directed to a half tone screen for rotary gravure printing. U.S. Pat. No. 4,301,583 of Nov. 24, 1981 is directed to an anilox roll. The last two mentioned patents are characterized in that the cells defined in the surface of the roller include connecting channels. This feature is said to facilitate ink distribution, and in the case of U.S. Pat. No. 4,301,583 to minimize moire effects and ink drying or caking in the cells.

There has recently been a trend to the use of high viscosity inks. This trend has, in no small measure, been spurred by the requirements of various governmental authorities that the use of viscosity reducing solvents be minimized.

The use of high viscosity inks has greatly increased the tendency of such inks to clog or cake in the cells, with the result that after relatively short periods the roll is no longer capable of depositing reliably consistent quantities of ink.

A further problem inhering in the use of high viscosity inks with conventional rollers resides in a greater tendency toward the formation of striations in the printed material. These striations are in a measure caused by difficulties in inducing an even spreading of the ink across the width of the roller, a difficulty which is exacerbated by the caking tendency discussed above, especially where the impressions include areas necessitating high ink density and closely adjacent areas where there is to be little or no ink density on the printed image.

A further drawback of known anilox rolls resides in the tendency toward the creation of moire effects, especially unless particular care is taken by the organization creating the printing cylinder to orient the pattern of the cylinders in such manner as to assure a non-registering relation with the pattern of the anilox roll.

While roll configurations such as shown in U.S. Pat No. 4,301,583 have, in a measure, provided somewhat improved results where used in conjunction with high viscosity inks, the results have been less than totally satisfactory in that ink clogging and caking have remained a problem.

SUMMARY OF THE INVENTION

The present invention may be summarized as directed to an improved anilox roll which, while useful and providing an improved result with inks of any viscosity, is especially adapted and effective for the distribution of so-called high viscosity inks.

In accordance with the invention, the anilox roll is provided on its surface with a multiplicity of depressed cells, generally in concentrations from about 45 to 360 per lineal inch in each direction. The cells are arranged in chains of cells extending in adjacent helical patterns, the walls defining the chains of cells separating each such chain from each adjacent chain. The cells of a given chain are connected by channels which enter each cell of a chain and exit to the next adjacent cell of the chain.

The characterizing features of the invention include the walls of each cell being formed by side portions extending generally circumferentially about the roll, i.e. in planes generally perpendicular to the roller axis, the cells including end portions linking the termini of the side wall portions, said end portions extending at an angle of from about 22° to about 28°, and optimally at 26° relative to the longitudinal axis of the roll.

The cells of a given chain are connected by channels formed in the end walls, the channels entering and exiting from each cell at a position along the end wall displaced from the apex of the cell, i.e. displaced from the circumferential leading and trailing edges of the cells.

Additionally, the flow paths defined by the channels are directed generally circumferentially of the roll whereas the chains of the cells extend at helix angles displaced from circumferential and preferably at helix angles of from about 22° to 28°.

It has unexpectedly been discovered that an anilox roll having the described characteristics functions efficiently to flush the cells during each pass between the doctor blade or equivalent, with the result that there is virtually no tendency toward caking or clogging of the cells regardless of whether or not the printing process as respects each cell extracts or fails to extract the full cell capacity at each pass over the pattern.

This condition is in contrast to anilox rolls heretofore known wherein, despite the presence of channels between adjacent cells, significant caking and clogging results.

A further advantage of the instant anilox roll resides in its compatability with any of the standard patternings employed in the formation of printing rolls whereby selection of the cell angles in the range of from about 22° to 28°, and optimally 26°, minimizes moire pattern effects without the necessity for taking special precautions in the fabrication of the pattern.

In addition, the described anilox roll functions to effect efficient spreading of ink, with resultant elimination of striations on the printed image.

It is accordingly an object of the invention to provide an improved anilox roll especially useful in conjunction with high viscosity inks.

A further object of the invention is the provision of a roll of the type described which efficiently functions to flush the cells during each rotary cycle whereby it is assured that there is no likelihood of formation of clogging residues not only at the cell centers but also throughout the volume of the cell.

A further object of the invention is the provision of an anilox roll of the type described having improved wear resistant properties due to the fact that a doctor blade bearing against the surface of the roll is supported at all times by essentially equal land areas of the tops of the cell forming walls.

Still a further object of the invention is the provision of a roll of the type described which results in minimization of striations and moire pattern effects.

To attain these objects and such further objects as may appear herein or be hereinafter pointed out, reference is made to the accompanying drawings, forming a part hereof, wherein.

Figure 1:
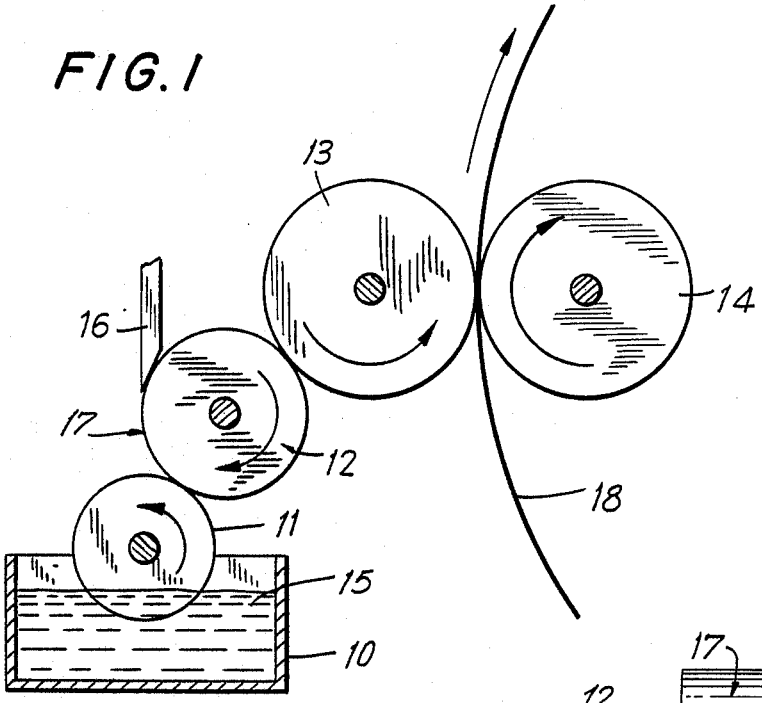
FIG. 1 is a diagrammatic side elevational view of a printing assembly incorporating the metering roll in accordance with the invention.
Figure 2:
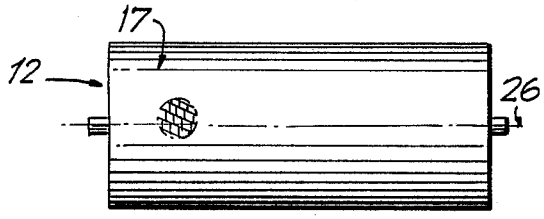
FIG. 2 is a side elevational view of the roll.

Referring now to the drawings, there is shown in FIG. 1, in schematic fashion, an essentially conventional printing apparatus including an ink fountain 10, a fountain roll 11, a metering roll 12 which is the subject of the present invention, a printing cylinder 13 and an impression cylinder 14. The manner of operation of the printing system described is well known per se and will only briefly be recounted below.

The fountain 10 is filled with an ink supply 15. A fountain roll 11 immersed in the ink is in tangential contact with the surface of metering roll 12. Optionally the fountain roll may be dispensed with and the metering roll directly immersed in the ink supply.

A wiper mechanism, which in the illustrated embodiment is comprised of a doctor blade 16, is disposed in wiping engagement with the surface 17 of the metering roll 12 and functions to remove excess quantities of ink from the surface of the roll. As will be apparent from the ensuing disclosure, the interaction of the doctor blade with the roll 12 induces a unique flow pattern of the ink. Alternatively to the doctor blade, wiping apparatuses of a different sort may be employed.

The surface 17 of the metering roll is covered with a pattern of minute cells, to be more fully described hereinafter, the cells functioning to deliver metered and accurately repeatable quantities of ink to the printing cylinder 13.

The printing cylinder, as is well known, includes an engraved or otherwise formed pattern which receives increments of ink from the metering roll, the amounts of ink withdrawn from the cells being a function of the pattern density of the cylinder 13.

Printing is effected by passing a web or sheet 18 to be imprinted in the nip between the printing cylinder 13 and the impression cylinder 14.

As will be understood by those familiar with the printing art, the diagrammatic view of FIG. 1 may represent the entire printing procedure where single color printing is effected. Where full color printing is to be effected, the arrangement illustrated is repeated for two or more additional stages, at each of which images of different colors are imparted to the web 18 in precise registry.

As is conventional, the patterning with which the images are engraved into the printing cylinder, where various stages of printing are employed, are offset one from the other and also from the patterning of the metering roll in order to avoid moire effects.

Where conventional or low density inks are employed in the printing process the metering roll 12 may be fabricated in accordance with above referenced U.S. Pat. No. 3,613,578, or a variety of other metering rolls.

It has recently been determined to be desirable for environmental reasons to minimize the solvents employed in printing inks, with the resultant increasing use of high viscosity inks. Where such inks are utilized there is a substantial tendency for ink residues to remain or be retained within the minute cells of the metering roll and particularly those cells which are engaged against low density areas of the printing cylinder, i.e. areas of the printing cylinder which do not transfer ink to the web. Under such circumstances there is a substantial tendency toward caking or clogging in the noted cells, the tendency being drastically increased with increased viscosity inks.

Figure 3:
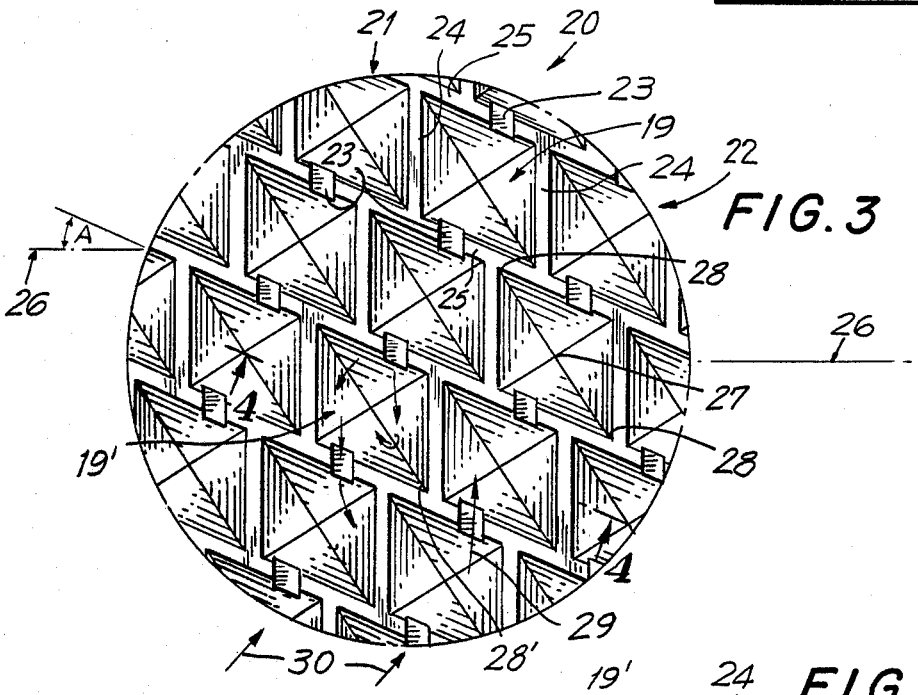
FIG. 3 is a greatly magnified view of a segment of the roll of FIG. 2.
Figure 4:
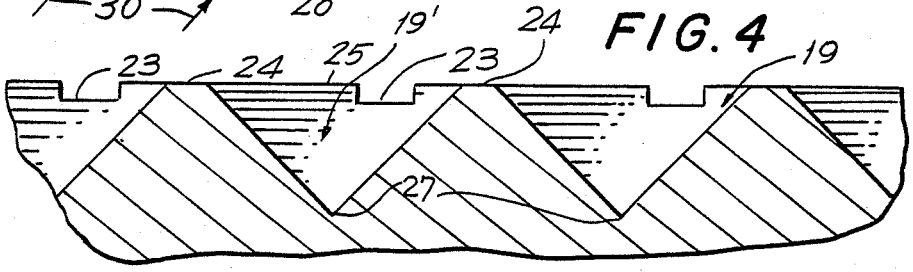
FIG. 4 is a further magnified section taken on the line 4—4 of FIG. 3.

The metering roll in accordance with the invention comprises a pattern or configuration of cells 19, best appreciated from an inspection of FIGS. 3 and 4.

The cells 19 are typically arranged in cell concentrations of from about 45 to about 360 cells per lineal inch in each direction. In accordance with the present invention the cells 19 are arranged in chains of cells, e.g. chains 20, 21 and 22, the cells of each said chain being connected by channels 23 extending between adjacent cells of a chain, The cells are each defined by side walls 24 and end walls 25, the channels 23 being formed in the end walls. The cells of each chain are thus isolated from the cells of the adjacent chain but the cells of a respective chain are interconnected by the channels.

While it is known to provide metering rolls including cells interconnected by channels, I have determined that for maximum efficiency the positioning of the channels with respect to the cells, i.e. the points of entry of the channels into the cells, has a significant influence on the effectiveness with which the cells are cleared during a printing run.

More particularly, the positioning of the channels and their correlation especially to the end walls 25 of the cells and the angular orientation of the end walls relative to the longitudinal axis 26 of the roll have important influences on the ability of the cells to self-clear during the printing operation.

As best seen in FIGS. 3 and 4, the cells of the illustrated embodiment are comprised of generally pyramidal configuration, with the apex 27 of the cells defining the points of deepest impression into the roll body. The pyramidal configuration of the cells is by no means critical and it should be recognized that the cells may be hemispherical, conical, etc.

The cell depth may vary in the range of from about 0.008" for lower cell concentrations, i.e. in the neighborhood of 45 cells per lineal inch, to 0.0009" for cell concentrations of about 360 per lineal inch, with intermediate concentrations incorporating cells of depths generally in a range intermediate the noted values.

The walls 24, 25, the top portions of which define the outer circumference of the roll, form bearing areas for the doctor blade 16, the width of the walls being likewise a function of cell concentration and varying typically, but without limitation, in the range of 0.003" for a 45 lineal inch cell concentration to 0.0002" per lineal inch for a 360 cell concentration.

An important feature of the invention resides in the alignment of the end walls 25 defining the cells at an optimal angle A (FIG. 3) of 26° relative to the longitudinal axis 26 of the roll. The angle A may vary from about 22° to about 28°, although, as noted above, the value of 26° has been determined to be optimal.

The channels 23 enter into and exit from the cells at positions offset from the circumferential leading and trailing edges of the cells, i.e. the leading and trailing portions 28 of the cells defined by the junction of side and end walls. Additionally, the channels 23 are aligned in such manner that the flow path 29 through the channels is offset from the helix angles see arrows 30, FIG. 3) defined by the chains of cells.

While the helix angle 30 of the chains of cells is not as critical to the successful operation of the roll as the offset angle of the walls 25 relative to the cylinder axis, it is desirable that such helix angle approximate the angle A, i.e. that the helix angle fall within the range of about 22° to 28°.

In the illustrated embodiment the flow path through channels 23, as illustrated by the arrows 29, FIG. 3, is circumferential, i.e. in the direction of a plane perpendicular to the longitudinal axis of the roll.

While the channels 23 have, for convenience of illustration, been shown as rectangular in transverse section, this configuration is by no means critical and typically, for ease of knurling, the channels may be V-shaped or arcuate in transverse section. The channels are of lesser depth than the maximum depth of the cells and typically vary from about one half to one third of the maximum depth of the cells.

As will be apparent from the preceding description, when a roll formed as described and bearing a surplus of ink on the surface thereof is caused to be shifted across a doctor blade resting on the surface of the roll, there is created within the individual cells a flow pattern which has been found to be highly efficient in completely displacing by agitation and churning action the increments of ink entrapped beneath the doctor blade and within the cell.

By way of example, a series of arrows in the cell 19' of FIG. 3 illustrates a flow pattern which, as will be perceived, functions to clear not only the apex 27 of the cell but also to flush or agitate ink components adjacent the junctions of the side and end walls of the cell.

I have determined that while the provision of a channel being linking cells as illustrated, for instance, in U.S. Pat. No. 4,155,766, is of some aid in preventing clogging or drying of ink, the entry and exiting of such channels at points of the cells coincident with the junctions of the side and end walls results in a centralized flow through the cells which, while tending to clear central portions of ink, fails to flush ink components from portions of the cells remote from the flow path.

The solution to this problem lies in a combination of factors, including offsetting the flow path of the channels from the helix angle of the cell chain and offsetting the flow paths of the two channels entering a given cell from each other.

Additionally, by directing the flow path of a channel entering a cell toward a junction of a side and end wall of the cell (as opposed to aiming the said path over the low point or the apex of the cell) the flushing efficiency is maximized in the portion of the cell where ink clogging is most likely to occur, namely, the junction of the end and side walls of the cells.

By providing an end wall inclination in the range of 22° to 28°, and optimally 26°, relative to the longitudinal axis of the roll, there is provided, in addition to optimized flushing action, an enhanced spreading action of the ink whereby a rapid and efficient lateral coverage of equal density across the roll is achieved.

The net result of the provision of a roll with the factors noted is an elimination of striations and a minimization or elimination of clogging of cells even where a high viscosity ink is employed.

While the problem of clogging is greatest in connection with high viscosity inks and the use of a roll in accordance with the invention most beneficial, in such environments it will be readily appreciated that the anti-clogging and ink spreading effects provide superior results when the roll is used in conjunction with lower viscosity inks.

As an additional benefit, the 26° angle of the end walls of the cells relative to the longitudinal axis of the roll minimizes moire pattern effects when employed in conjunction with printing cylinders formed in accordance with the conventional pattern angles used in the industry.

A further benefit derived from the use of the roll resides in increased wear-resistance of the roll. This benefit is achieved as a result of the fact that a doctor blade which engages the surface of the roll at a contact line parallel with the roll axis will at all times be supported by essentially constant areas of the tops of the cell defining walls. In conventional rolls wherein the corners of the cells are typically aligned with the longitudinal axis of the cell it will be appreciated that the wall area supporting the doctor blade is less where the blade traverses a cell corner than at positions displaced from the corner, with the resultant premature localized wearing of the roll.

As will be apparent to those skilled in the art and made conversant with the instant disclosure, numerous variations in details of construction may be made without departing from the spirit of the present invention. Accordingly, the same is to be broadly construed within the scope of the appended claims.

Having thus described the invention and illustrated its use, what is claimed as new and is desired to be secured by Letters Patent is:

1. A liquid metering roll comprising a cylinder having a multiplicity of outwardly open cells depressed into the surface thereof in cell concentrations of from about 45 to 360 cells per lineal inch, said cells being arranged in helically extending connected chains of cells defined by walls, the walls defining each chain of cells separating each such chain from each adjacent chain, the tops of said walls forming the outermost periphery of said roll, the walls defining each cell including side portions extending circumferentially of said roll along planes generally perpendicular to the roll axis, and end portions linking the terminal of said side portions, said end portions extending at an angle of from about 22° to 28° and optimally at 26° relative to the longitudinal axis of said roll, each said cell being thus defined by a pair of said side wall portions and a pair of said end wall portions, the cells comprising said chains being linked by channels formed in said end wall portions, said channels being of lesser depth that the maximum depth of said cells, said channels entering and exiting said cells at positions displaced from the circumferentialy leading and trailing edges of said cells, the flow paths defined by the channels of the cells being displaced one from the other.

2. The metering roll in accordance with claim 1 wherein said chains of cells extend about said roll at a helix angle of from about 22° to 28°.

3. A metering roll in accordance with claim 2 wherein said channels define flow paths entering and exiting said cells in directions offset from the helix angle defined by said chains of cells.

4. A metering roll in accordance with claim 3 wherein said flow paths defined by said channels are directed generally circumferentially of said roll.

5. A metering roll in accordance with claim 1 wherein said channels define flow paths entering and exiting said cells in directions offset from the helix angle defined by said chains of cells.

6. A metering roll in accordance with claim 5 wherein said flow paths defined by said channels are directed generally circumferentially of said roll.

7. A metering roll in accordance with claim 5 wherein said flow paths are directed generally toward the respective junctions of said side portions and end portions.

* * * * *